US008147099B2

(12) United States Patent
Thornton

(10) Patent No.: US 8,147,099 B2
(45) Date of Patent: Apr. 3, 2012

(54) APPARATUS AND METHOD FOR RECEIVING LIGHT FROM A POINT-LIKE SOURCE AND EMITTING LIGHT OVER AN EXTENDED SURFACE AREA

(75) Inventor: Shane Thornton, Barrington (GB)

(73) Assignee: Dialight Lumidrives Limited, York (GB)

( * ) Notice: Subject to any disclaimer, the term of this patent is extended or adjusted under 35 U.S.C. 154(b) by 471 days.

(21) Appl. No.: 12/163,765

(22) Filed: Jun. 27, 2008

(65) Prior Publication Data

US 2009/0080198 A1 Mar. 26, 2009

(30) Foreign Application Priority Data

Jun. 29, 2007 (GB) ..... 0712614.7

(51) Int. Cl.
*F21V 7/04* (2006.01)
*F21V 13/04* (2006.01)

(52) U.S. Cl. ..... 362/299; 362/303; 362/327

(58) Field of Classification Search ..... 362/297, 362/299, 303, 327, 355, 560, 629, 632–634
See application file for complete search history.

(56) References Cited

U.S. PATENT DOCUMENTS 2,418,195 A * 4/1947 Rolph ..... 362/217.05
5,036,445 A 7/1991 Osteen
5,668,913 A 9/1997 Tai et al.
5,806,955 A * 9/1998 Parkyn et al. ..... 362/612
5,898,267 A 4/1999 McDermott
6,065,846 A * 5/2000 Kato et al. ..... 362/30
6,193,383 B1 * 2/2001 Onikiri et al. ..... 362/26
6,283,613 B1 9/2001 Schaffer
6,456,437 B1 9/2002 Lea et al.
6,536,923 B1 * 3/2003 Merz ..... 362/327
6,582,103 B1 6/2003 Popovich et al.
6,674,096 B2 1/2004 Sommers
6,811,277 B2 * 11/2004 Amano ..... 362/602

(Continued)

FOREIGN PATENT DOCUMENTS

EP 1589282 A1 10/2005

OTHER PUBLICATIONS

Search Report from the European Patent Office for corresponding European Application No. EP08159012.7-2423, Jun. 1, 2011, 7 pages.

*Primary Examiner* — Alan Cariaso
(74) *Attorney, Agent, or Firm* — Klarquist Sparkman, LLP

(57) ABSTRACT

A method and apparatus are disclosed for receiving light from one or more light sources, each of which comprises a substantially point-like light source. The received light is them emitted over an extended surface area including a first surface of an optical controller arranged to refract light received from at least one light source, a second surface of the optical controller arranged to reflect the light received from the first surface of the optical controller, the first surface and the second surface being arranged with respect to each other to enable total internal reflection of the light reflected from the at least one light surface, and a plurality of reflection elements located within the optical controller arranged to alter the path of the light traversing the optical controller so as to direct light out of the optical controller.

20 Claims, 8 Drawing Sheets

U.S. PATENT DOCUMENTS

| | | | | |
|---|---|---|---|---|
| 7,072,096 | B2 | 7/2006 | Holman et al. | |
| 7,083,313 | B2 * | 8/2006 | Smith | 362/555 |
| 7,278,775 | B2 * | 10/2007 | Yeo et al. | 362/627 |
| 7,445,371 | B2 * | 11/2008 | Ma et al. | 362/633 |
| 2003/0235050 | A1 * | 12/2003 | West et al. | 362/327 |
| 2006/0119751 | A1 * | 6/2006 | Suehiro et al. | 349/5 |
| 2006/0187651 | A1 * | 8/2006 | Kim et al. | 362/27 |

* cited by examiner 102
602
603
603
603
603
606
605
606
604
LINKED

APPARATUS AND METHOD FOR RECEIVING LIGHT FROM A POINT-LIKE SOURCE AND EMITTING LIGHT OVER AN EXTENDED SURFACE AREA

CROSS REFERENCE TO RELATED APPLICATION

The present application claims priority to Great Britain Patent Application No. GB0712614.7, filed Jun. 29, 2007, which is incorporated herein by reference.

FIELD

The present invention relates generally to the field of lighting systems. In particular, but not exclusively, the present invention relates to a system for converting a first light source into an extended light source which emits light over a larger area than the first light source. Even more specifically, but again not exclusively, the present invention relates to a system for converting light output from a light emitting diode (LED) or other such substantially point-like light source into an extended light source which emits light evenly over a larger area.

BACKGROUND

Applications for embodiments of the present invention may be found in the general area of luminaires, this may include but is not limited to: uplighters, downlighters, wallwashers and distributed arrays of luminaires. More generally, this system can be employed in any luminaire where a point-like nature of an illumination source may otherwise provide an unwelcome excessive intensity. Such excessive intensity is known to be discomforting.

LEDs are being used increasingly as the light source of choice for many lighting applications. A small physical footprint, high efficiency and longer lifetimes mean that LEDs offer considerable advantages over conventional light sources. As the efficiency has increased the luminous output has increased without significant change in the size of the emitter area. In addition, advances in thermal management techniques and improved substrate materials have meant that it is possible to make bigger devices that can withstand higher current densities. Currently die sizes for the high output devices are known to vary from approximately 350×350 microns to 1×1 mm or more.

Thus, technological advances in manufacturing and packaging have contributed to produce devices that are effectively point sources but which are known to be able to emit, for example, 70-80 lumens from a 5 W input using three discrete emitters within a package area of a few square millimetres. However, such devices emit light over a relatively small surface area, and are therefore often undesirable for use in general luminary applications.

Attempts have been made to overcome this problem particularly with such emitters used as the light source in a packaged luminaire. Indeed many examples of relevant prior art systems can be found in which an LED is embedded into or surrounded by a refractive surface or a reflective surface to increase the surface area of the devices luminance. Many standard LED lenses now exist which combine some element of reflection via total internal reflection at one surface together with a refractive element, for example a Fresnel lens surface. See for example U.S. Pat. No. 5,898,267. These lenses have the advantage of being very efficient and can control the light distribution, sometimes making it collimated and in other examples making it diverge at a particular rate.

Whilst these lenses serve a specific purpose many suffer from the problem that they require appreciable depth to create the extended emitter surface and control the light. Such appreciable depth limits the applications that such a device can be used for and is thus an undesirable feature of such devices. U.S. Pat. No. 6,283,613 discloses such a luminaire device.

In some applications the size of the package sets a limitation on the depth of the optical controller. In extreme examples, a lens or other such optical controller only 2-3 millimetres deep may be required. When such small depths are applied to the above-described luminaire device the LED is so close to the optical controller surfaces and the controller is so thin, that Fresnel facets limit the device's effectiveness. Hence such devices are limited by having a minimum depth. Often the result of this arrangement is that the central intensity of the LED dominates any attempt at optical control. In such circumstances a direct view of the emitter can be seen. This is known to be uncomfortable for observers, akin to glare or hot spots.

Further attempts to convert an LED light source from a point source into an extended light source have been tried. For example, U.S. Pat. No. 6,582,103 discloses a method wherein a reflective cavity in which the LED or point source is situated, is combined with a cuspated optical diverter. Light from the LED is distributed by the optical diverter onto the reflective surfaces of the cavity. Before exiting the cavity light passes through a conditioning element which comprises a sheet diffuser and a prismatic sheet such as brightness enhancing film. Although this technique achieves the desired effect of converting the point source into an extended source it does require sufficient physical size to include a reflector cavity and various optical components. For example, a depth of approximately less than 3.5 inches is known to be required between the source and the sheet that illuminates the reflective surfaces. Hence this type of device solution cannot produce an extended light source within a depth of only a few millimetres. Again this method limits the applications in which such a device can be used in. Hence such devices are known to be undesirable.

Others have attempted to solve this problem by using optical sheets for spreading the light. For example, U.S. Pat. No. 5,668,913 discloses a light expanding system that converts a point light source into a collimated linear or planar output. The device comprises a light source, together with a beam collector and a light pipe adjacent to a multiplicity of prismatic elements. For various reasons this arrangement cannot be placed directly over the source and limited in depth to a few millimetres. Consequently such devices are known to be unsatisfactory.

In U.S. Pat. No. 6,456,437 an optical sheet with a structured surface is disclosed in which surface prisms refract incoming collimated light and other prisms use total internal reflection to reflect the incoming collimated light. By varying the prism design and randomly alternating the prism type, a collimated beam can be spread out in angle-space. Although this design spreads the light out it also requires the light from the point source to be collimated by an intermediate optical component. Even the fastest lens with an f-number of 0.5 would need to be at least half the depth of the extended source length. Hence, this design requires a reasonably large depth. Such depths are known to be undesirable.

Another attempt to solve this problem is disclosed in U.S. Pat. No. 7,072,096 in which the output from LED arrays is concentrated within a limited angular range. The light is controlled by surrounding each LED with a reflecting sidewall that directs light onto a prismatic film. In such a device the reflector walls must be deep enough to control the light and it is therefore not suited to a low profile application.

Other attempts have been made to solve this problem by modifying the external light intensity distribution by using a reflective surface. U.S. Pat. No. 6,674,096 discloses using an encapsulation around the LED in which a depression is made directly over the emitter surface. The depression has a predetermined curvature symmetrical about the optical axis of the LED. The curved surface is then reflectively coated. Light rays emerging from the die are reflected at normal to the optical axis of the LED and are refracted at the encapsulant-air boundary. In this manner the point-like light source is converted into an annular emitter. Although useful in certain applications this invention is only of use in creating a side emitter and not an extended area source. The limited applications of such a device thus make it somewhat undesirable.

EP 1 589 282 A1 discloses a thin plate light for motor vehicles comprising a transparent plate between two reflective surfaces. The primary reflective surface covers the whole of the bottom of the plate area and is designed to reflect light rays out through the front of the transparent plate. A secondary reflector is formed on the front surface of the plate, directly in line with the point source, which is located within the transparent plate and coincident with the bottom surface. The secondary reflector is designed so that its aperture extends across the front of the plate so that a ray striking the front plate directly will always be totally internally reflected back towards the primary reflective surface. The primary reflective surface will reflect this ray so that the ray strikes the front surface a second time but now at normal incidence. The ray thus exits the lamp. The curvature of the secondary reflective surface is designed so that rays are reflected from the surface onto a different portion of the primary reflective surface which has been designed to reflect these rays out through the front face of the plate. Thus each zone or facet of the primary reflective surface has been designed to co-operate either with rays reflected by total internal reflection or from the secondary reflective surface. However, it is an inevitable consequence of this design that light cannot escape from the central region of the lamp, which is covered by the secondary reflector. Such uneven light distribution is known to cause discomfort when viewed directly or due to the uneven light distribution it creates on objects.

SUMMARY

It is an aim of particular embodiments of the present technology to at least partly mitigate the above-mentioned problems.

It is an aim of certain embodiments of the present technology to provide an optical controller and/or lighting methodology that converts a substantially point-like light source such as an LED into a substantially extended light source.

It is an aim of certain embodiments of the present technology to provide an optical controller and/or methodology that converts a point source to an extended source within a minimal distance which shall preferably be less than 3 mm.

It is an aim of certain embodiments of the present technology to provide an extended light source that does not have a dark region in the area over the light source and that the intensity distribution across the extended area will be substantially even.

It is an aim of certain embodiments of the present technology to provide a light source that will remain substantially a Lambertian source emitting light in all directions.

According to a first aspect of the present technology, there is provided an apparatus for receiving light from one or more light sources, each comprising a substantially point-like light source, and emitting the light over an extended surface area, comprising:

a first surface of an optical controller arranged to refract light received from at least one light source;

a second surface of the optical controller arranged to reflect the light received from the first surface of the optical controller, said first surface and said second surface arranged with respect to each other to enable total internal reflection of the light received from said at least one light source; and a plurality of reflection elements located within the optical controller arranged to alter the path of the light traversing the optical controller so as to direct light out of the optical controller.

According to a second aspect of the present technology, there is provided a method for manufacturing an apparatus for receiving light from one or more light sources and emitting the light over a larger surface area, comprising the steps of:

providing an optical controller comprising:

a first surface of the optical controller arranged so as to refract light received from at least one light source;

a second surface of the optical controller arranged to reflect the light received from the first surface, said first surface and said second surface arranged with respect to each other to enable total internal reflection of the light received from said at least one light source; and a plurality of reflection elements located within the optical controller arranged to alter the path of the light traversing the optical controller so as to urge it to exit the optical controller;

providing at least one light source to emit light towards the optical controller; and providing an outer casting onto which the at least one light source and the optical controller are secured with respect to each other.

According to a third aspect of the present technology, there is provided a method for receiving light from one or more light sources and emitting the light over a larger surface area, comprising:

receiving light from at least one light source at a first surface of an optical controller and refracting the light as it passes into the optical controller;

receiving the light at a second surface of the optical controller and reflecting the light received from the first surface of the optical controller, said first surface and said second surface arranged with respect to each other to enable total internal reflection of the light received from said at least one light source; and altering the path of the light traversing the optical controller so as to urge the light to exit the optical controller, said altering provided by a plurality of reflection elements located within the optical controller.

Certain embodiments of the present technology provide a method and apparatus for converting a light source into an extended light source.

Certain embodiments of the present technology provide a method and apparatus for converting a light source into an extended light source which emits light evenly over a larger area.

Certain embodiments of the present technology provide a method and apparatus for converting a light source into an extended light source which does not have significant glare.

Certain embodiments of the present technology provide a method and apparatus for converting a light source into an extended light source within a minimal distance.

Certain embodiments of the present technology provide a fast and simple method for manufacturing an apparatus for converting a light source into an extended light source.

The foregoing and other features and advantages will become more apparent from the following detailed description, which proceeds with reference to the accompanying figures.

BRIEF DESCRIPTION OF THE DRAWINGS

Embodiments of the present invention will now be described hereinafter, by way of example only, with reference to the accompanying drawings in which.

In the drawings like reference numerals refer to like parts.

DETAILED DESCRIPTION

Figure 1:
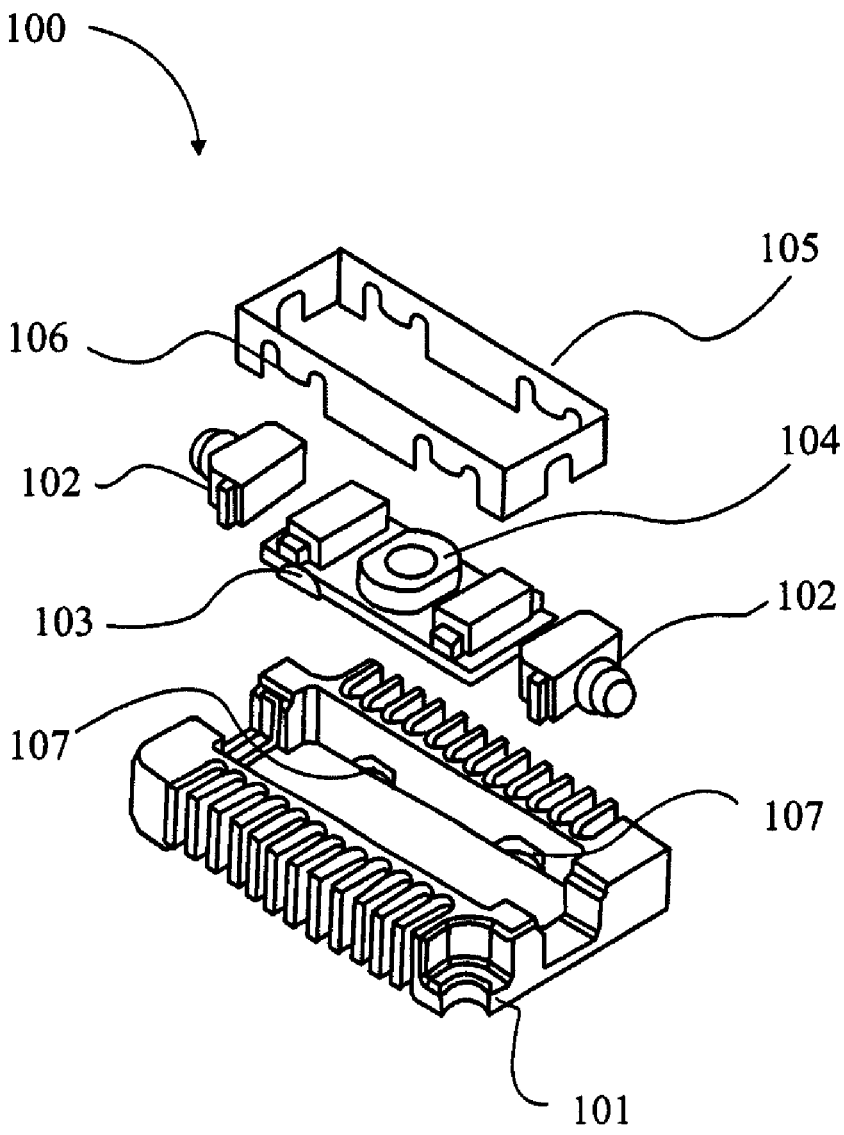
FIG. 1 illustrates an exploded schematic view of a lighting assembly.

FIG. 1 illustrates an exploded schematic view of a lighting assembly 100. This embodiment of the present invention comprises an outer casting 101, cable strain relieving bungs 102, a metalised PCB 103 on which the LED 104 is mounted, and the optical controller 105. The optical controller 105 is a moulded part, mounted on the casting 101, that includes four tabs 106 which can be clipped into four mating recesses 107 in the outer casting to secure the lens in place with respect to the LED. It should be understood that the optical controller 105 could be secured to the outer casting 101 by other means. For example it could be secured by being screwed in position, by sliding into a slot within the outer casting 101 or by any other securing means. Furthermore, the LED does not have to be of the same form as that shown in FIG. 1 and it is possible that more than one LED could be attached to one outer casting.

Figure 2:
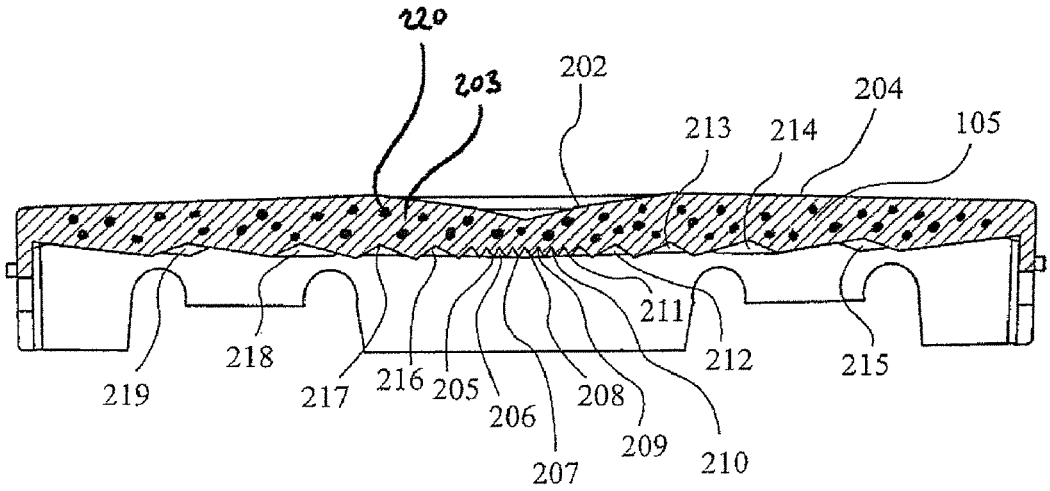
FIG. 2 illustrates a cross-section of an optical controller.

FIG. 2 illustrates a cross-sectional view of an embodiment of the present invention. The optical controller 105 which caps the lighting assembly is made of transparent material such as polycarbonate or acrylic or any other material that can be moulded. The underside of the component, which faces towards the LED, has a circularly symmetric surface structure composed of numerous facets or prism like features. Such facets or prisms effectively act as refractive elements. It is to be noted that such facets could be in other patterns other than circularly symmetric. However, a circularly symmetric surface structure is known to provide advantageous results. On the top surface of the controller which faces away from the LED a conical depression 202 is impressed or formed in some way into the surface 204.

Each facet on the underside of the cap is designed to perform a specific task. Certain facets 205 to 211 refract light onto the conical depression 202. The light in this region is predominantly incident on the conical surface at an angle where total internal reflection occurs. The light is then reflected along the length of the optical controller at an angle normal to the optical axis of the LED 104.

Other facets 212 to 219 are arranged outwardly away from a central region of the optical controller and receive light from the LED and refract it into the body of the optical controller at an angle that allows total internal reflection to occur at surface 204 and those surfaces facing this surface, effectively formed by the facets.

In addition to the base transparent material 203 from which the optical controller is manufactured, a plurality of reflection elements 220 in the form of a particulate-based pigment is included prior to moulding. The pigment is provided to reflect light traversing the transparent material so as to urge it to exit the transparent material. The pigment is mixed so that it is homogeneously distributed throughout component volume. Such homogeneous distribution should provide an even spread of light exiting the transparent material. The percentage of loaded material is chosen so that a typical ray may undergo up to five internal reflections before encountering a particle. In this manner the light is mostly guided along the length of the optical controller but at some stage it will encounter a pigment particle and be scattered out of the controller at some arbitrary angle. It should be noted that other alien elements could be added to the transparent material, or this effect could be achieved through other means such as deformations in the transparent material structure.

Figure 3:
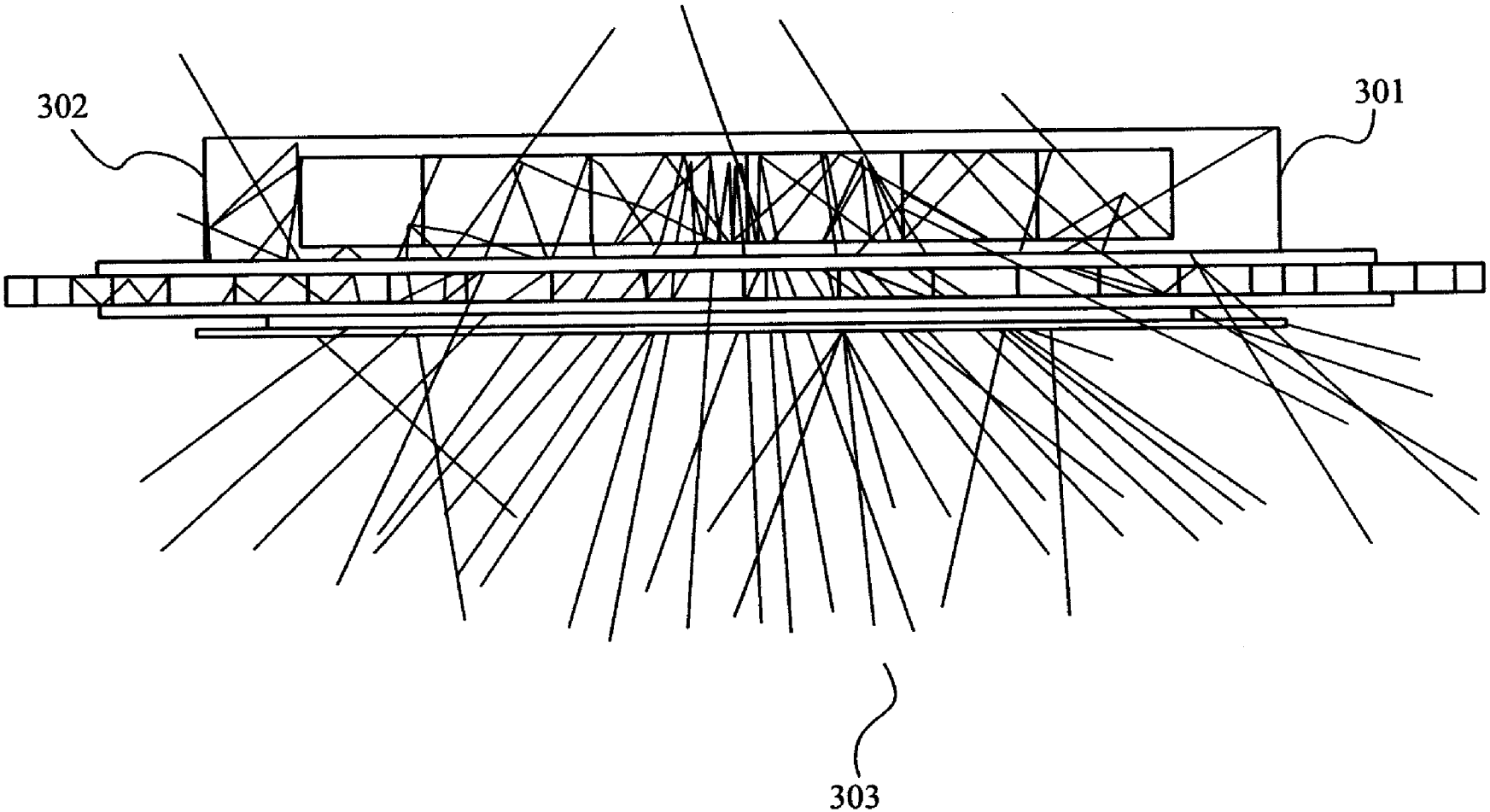
FIG. 3 illustrates a ray-trace model of the optical controller in cross-section showing the rays emerging along the extended length.

FIG. 3 illustrates a ray-tracing model of the optical controller in cross-section, showing the rays emerging along the extended length. Surfaces 301 and 302 correspond to the limiting edges of the controller. The LED, not shown, is situated in the middle of the controller, half-way between surfaces 301 and 302. Rays can be seen starting in the middle and then being bounced around inside the controller until they eventually emerge through the exit surface and into the ambient area 303. This complex view shows that rays may not be completely evenly distributed across the area of the controller exit surface.

In a further enhancement to the design, the area around the controller sides on the inside of the outer casting 101 may be made reflective or painted white to reflect light back into the controller and improve the ray distribution. In the same manner the top surface of the PCB may also be made reflective to achieve the same end.

Figure 4:
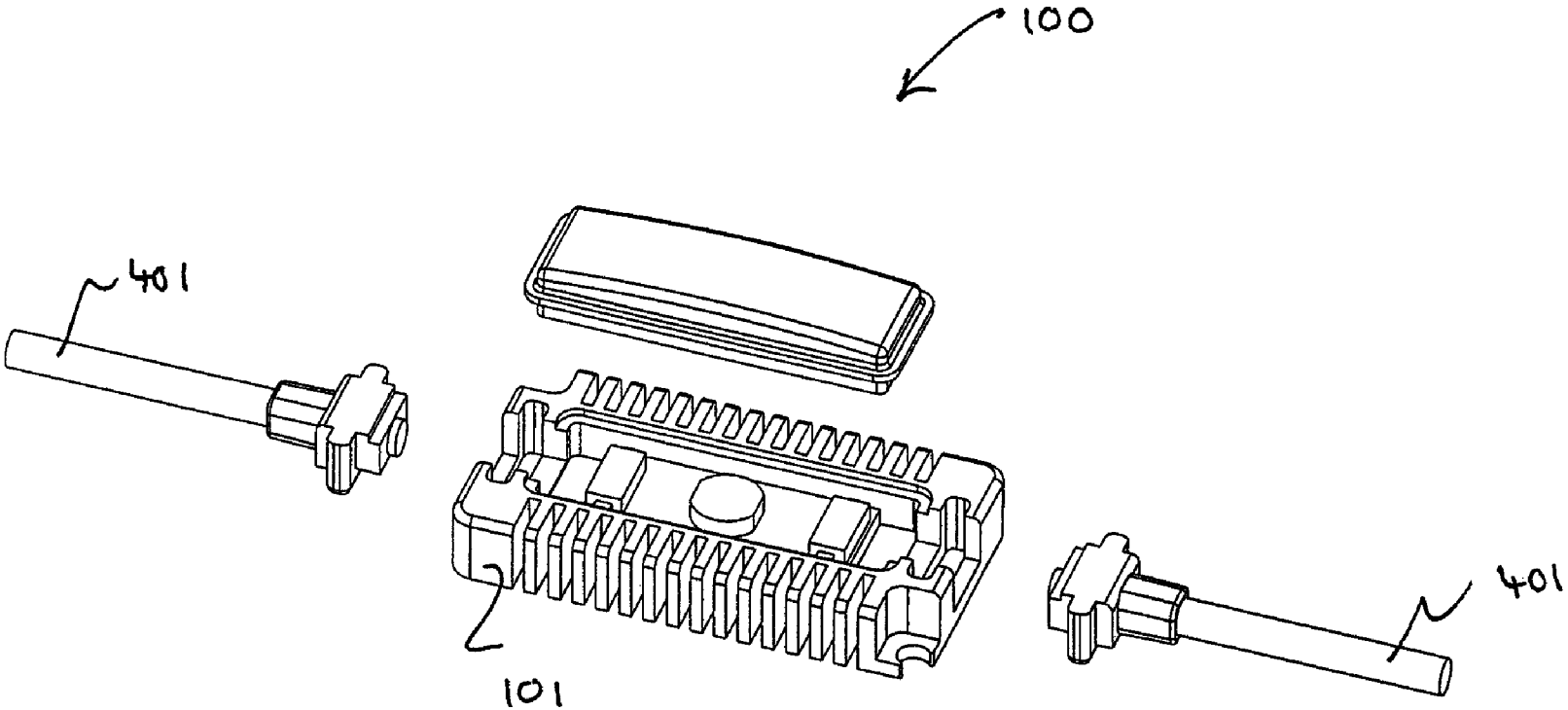
FIG. 4 illustrates a lighting assembly.
Figure 5:
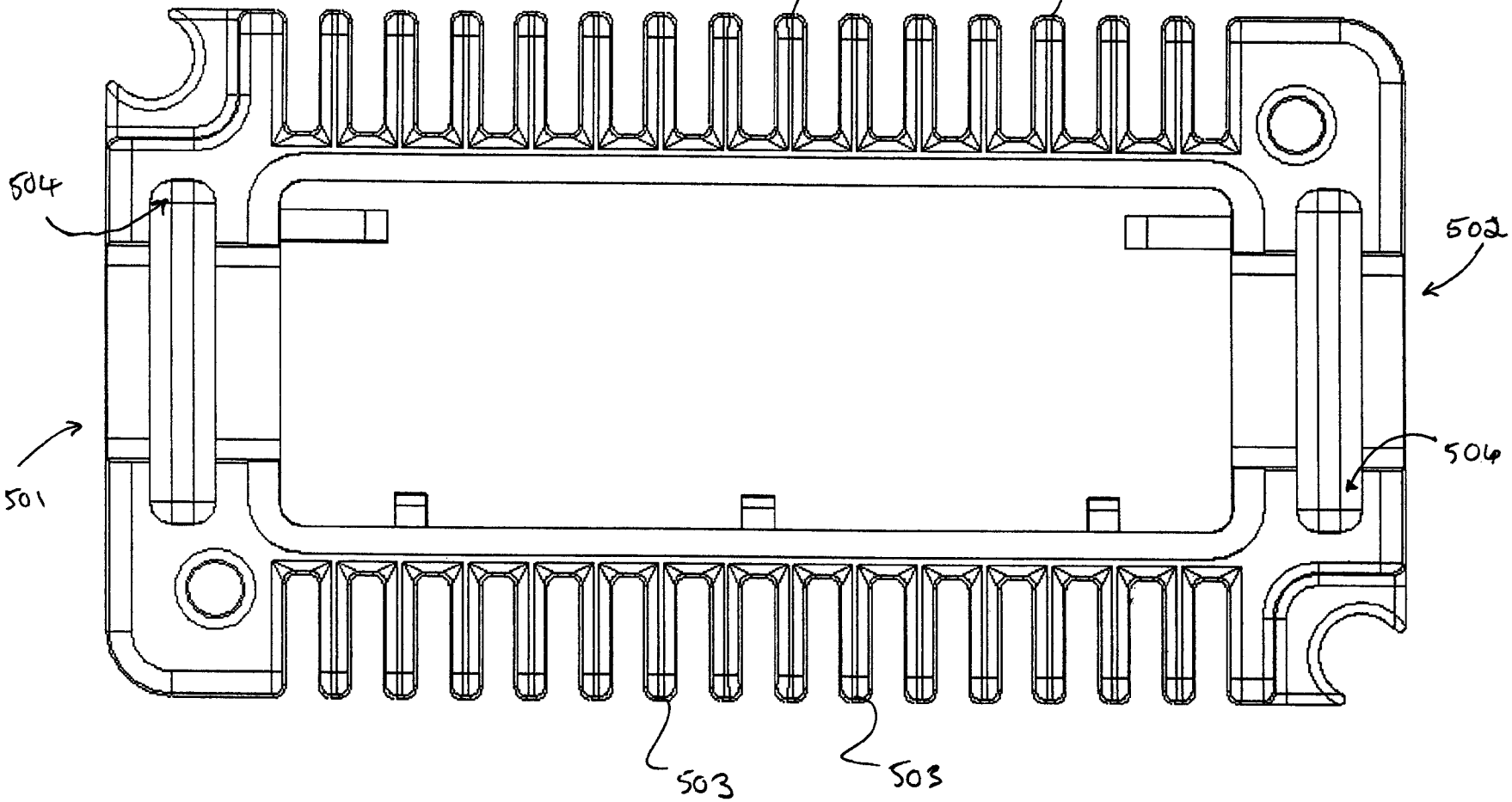
FIG. 5 illustrates a casting body.
Figure 6:
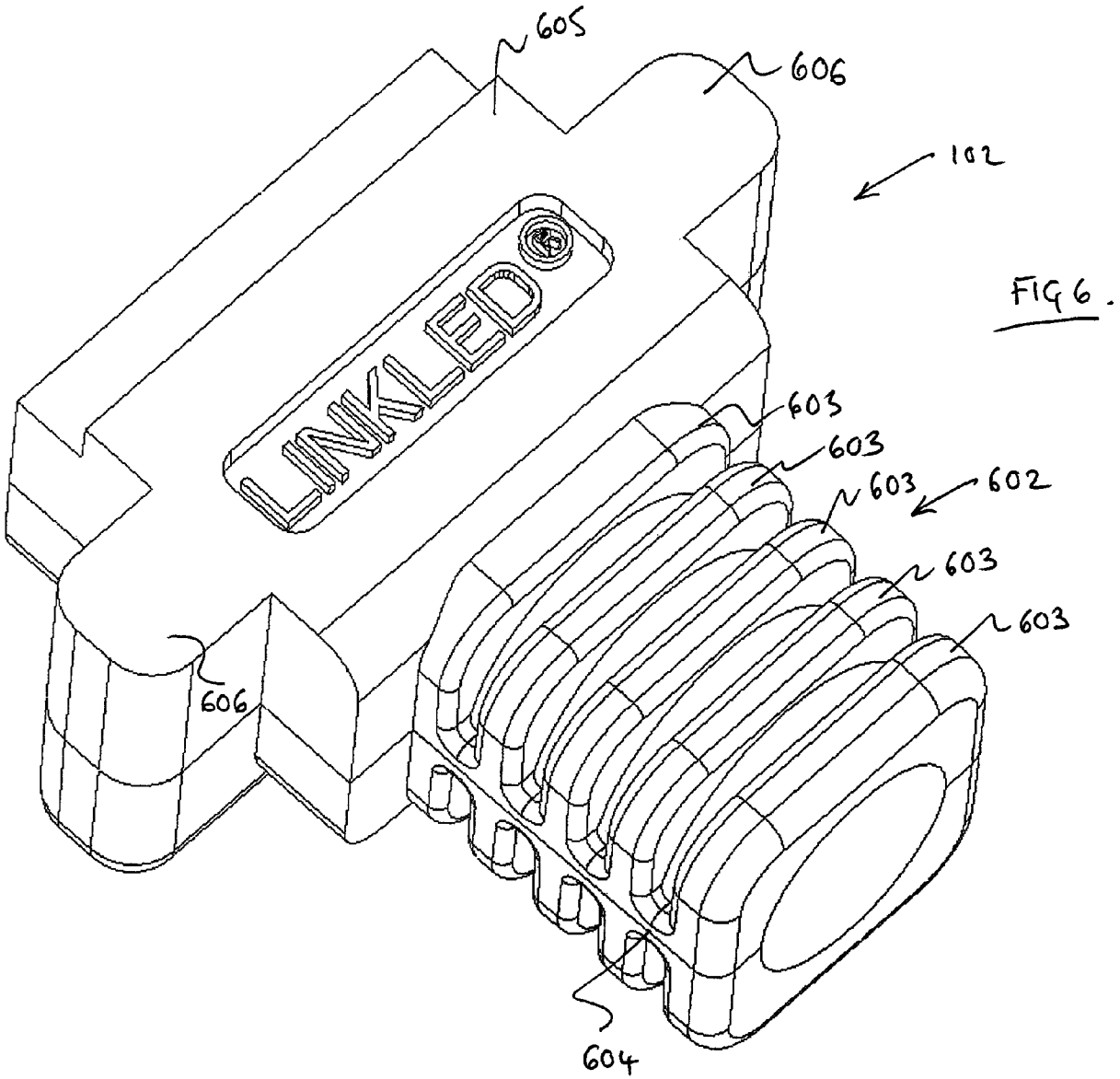
FIG. 6 illustrates a cable/restraint/seal.

FIG. 4 illustrates a further exploded systematic view of the lighting assembly 100. The outer casting 101 is illustrated more clearly in FIG. 5 and is a substantially integrally formed body 500 formed from a material such as metal having a high thermal conductivity. The body has a first opening 501 at a first end thereof and a second opening 502 at a further end thereof. Fins 503 extend along sides of the body so as to help dissipate heat when the light source is operational. As illustrated in FIG. 4 cables 401 which incorporate wires for supplying power and signals to the light source in the lighting assembly pass through openings in the body of the casting 101. Strain on the cables which may cause fracture of wires is relieved by virtue of strain relievers formed as rubber bungs 102 which are illustrated more clearly in FIG. 6. The rubber bungs 102 include an elongate neck 602 which extends partially along the length of the cable. The neck 602 includes five disk-like regions 603 connected together by a minor webbed region 604. In this way the disk portions can flex easily with respect to each other to move with the cable as it moves. Nevertheless some resistance is offered to movement of the cable which prevents fracturing of wires in the cable. The strain relief bung includes a substantial body portion 605 through which the cable passes into the central zone of the lighting assembly casting. Movement of the cable within this body portion 605 is constrained with the stiffness offered by the bung increasing from the neck region into the inner zone. In this way over-bending of the cable can be prevented. The body 605 of the strain relieving bung includes ears 606. These fit in mating recesses 504 in the openings of the casting 101. The interaction of the ears and recesses acts as a securing mechanism to locate the bungs in the openings at predetermined positions so as to avoid overstrain in the cables and also provide an extension to the path followed by any water into the lighting assembly. The increased and labyrinthine nature of the path formed between the outer surface of the cable strain relievers and body 101 reduce water ingress which may harm the light source.

Figure 7:
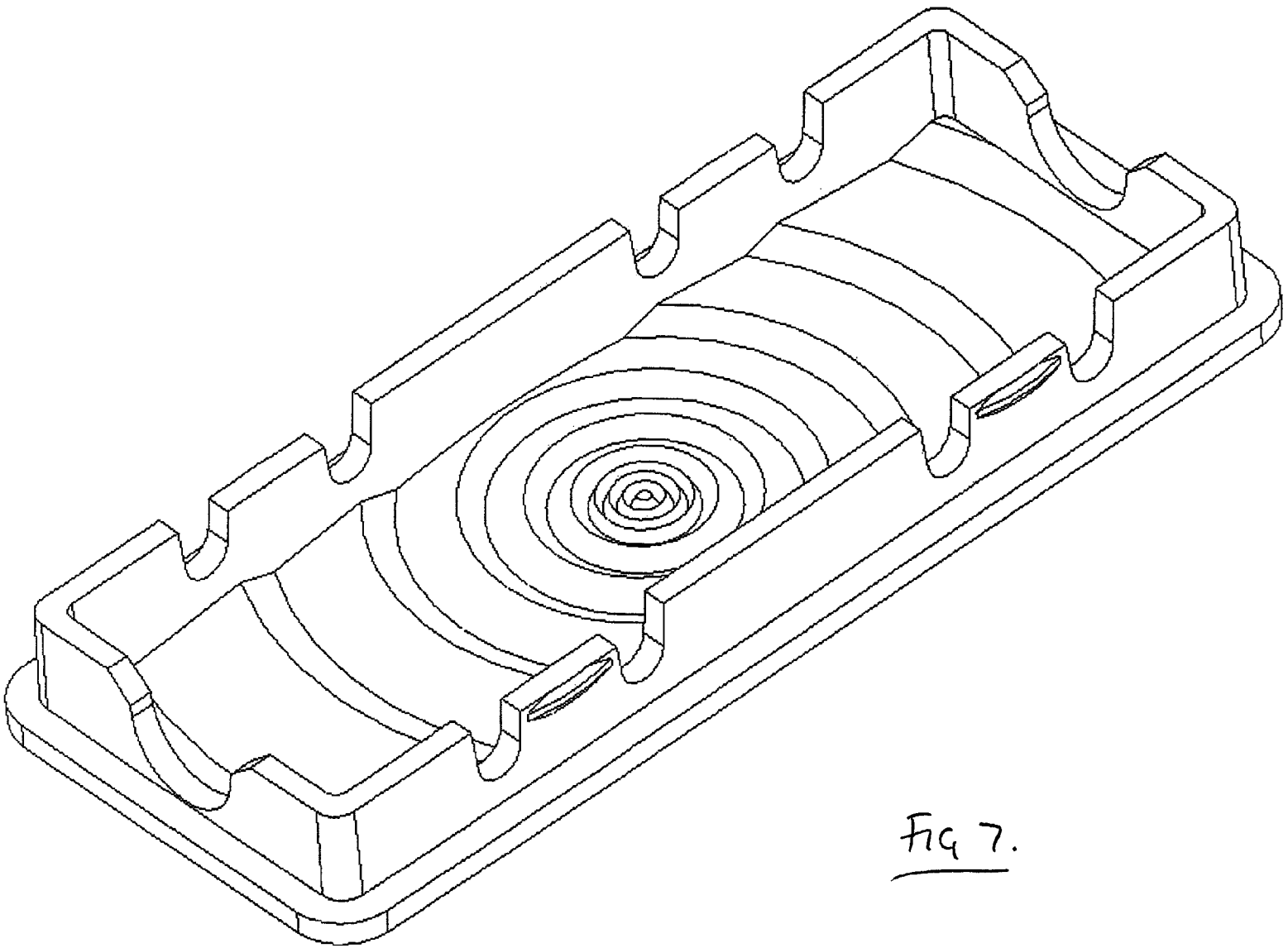
FIG. 7 illustrates an underside of an optical controller.
Figure 8:
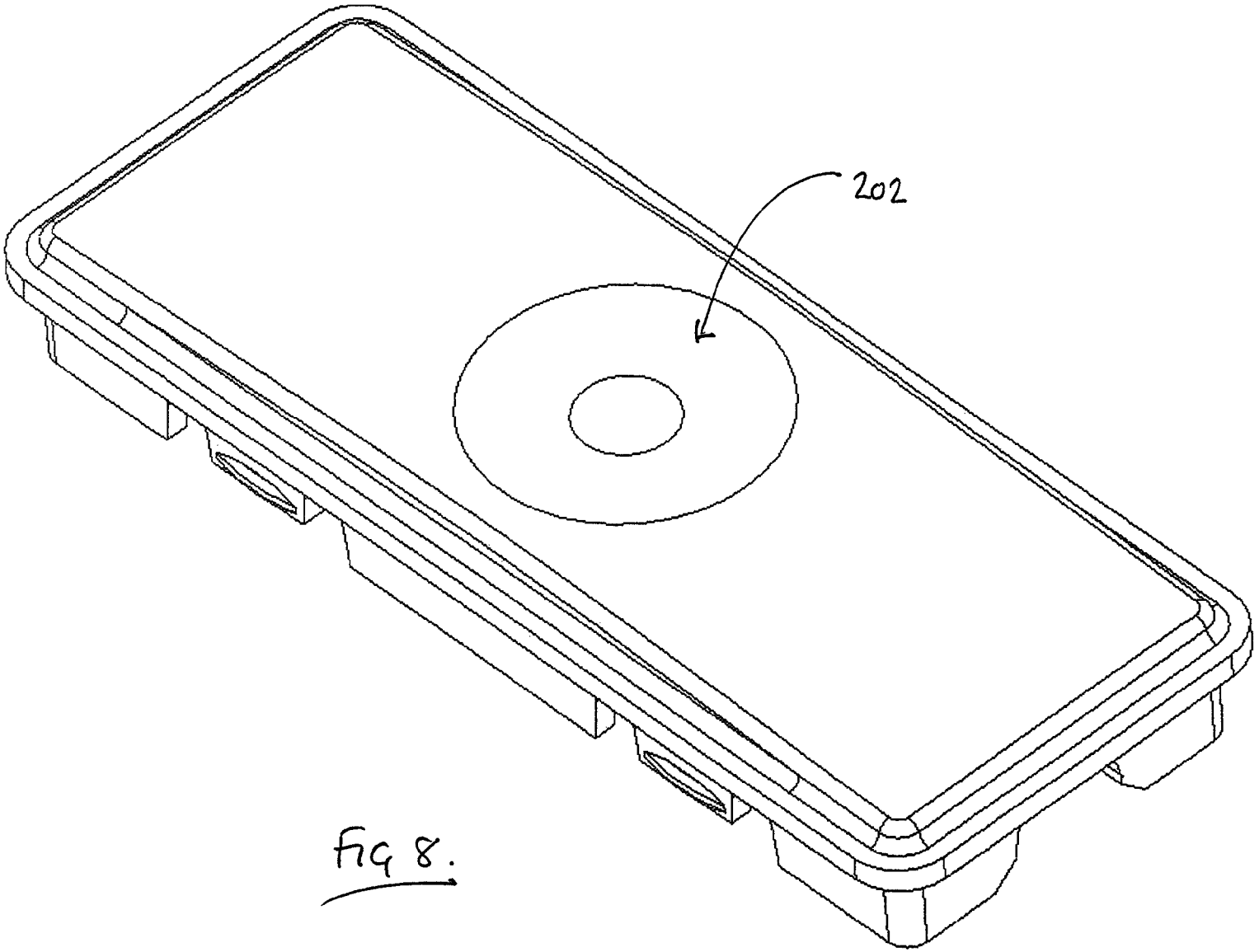
FIG. 8 illustrates an upper surface of an optical controller.

FIG. 7 illustrates an underside of the optical controller 105 in more detail and illustrates facets 205 to 211 in the central region under the conical depression 202 which is illustrated more clearly in FIG. 8.

According to an embodiment of the present invention the LED cluster is thus assembled on an aluminium backed PCB and located directly onto a heat sink. The residual heat generated by the LED can thus be dispersed. The heat sink has sufficient surface area and/or mass to draw heat away from the LED.

Under certain circumstances the lighting assembly will be utilised in wet locations and may need to remain operational even if immersed in water. IP67 is a standard which such assemblies should adhere to and which means that the assembly is protected against dust ingress and can be immersed in water to a depth of 1 metre and still be operational and safe. In order to maintain this IP rating the compartment where the LED is housed is partially encapsulated with a clear resin. This resin covers all of the electrical components thus making them waterproof. Electrical conductors needed to supply power and signals to the LEDs need to enter and exit the compartment. The cable restraints are provided to provide a barrier whilst the encapsulation material is applied and thus prevents stress by manipulation of the cable and simultaneously acts as a retaining wall for resin during assembly.

A method of assembly of embodiments of the present invention will now be described. The LED cluster is supplied as a sub-assembly on an aluminium backed PCB with connectors and thermally conducted self adhesive tape. This assembly is placed in the heat sink body and pressed firmly down to ensure the tape has a good contact. The cable restraint is located in the body with the convoluted shape of the restraint fitting snugly into the body thus forming a labyrinthine path in order to present resin escaping later on in the process and to prevent/reduce water and dust ingress. Advantageously the cable restraint is made from a silicone rubber to allow its position on the cable to be manually altered. This allows any variation in wire strip length to be adjusted to suit. Subsequent to locating the cable restraints in position a polyurethane or silicone resin is poured into the LED enclosure. The depth of the resin is enough to encapsulate the electrical conductors and produce a watertight seal to IP67 rated standards. Subsequent to introduction of the resin the optical lens is lowered over the LED/LED cluster until it clicks into place. The liquid resin helps to make the location more permanent. At this point the assembly is fully sealed. The liquid resin hardens and completes the assembly. Each cable restraint not only offers strain relief to a respective cable as it is flexed and stretched but also acts as a part of a waterproof seal. The sliding ability of the cable restraint makes sure the assembly is a close to ideal fit in the assembly body.

It will be appreciated that although the preferred embodiment has an LED source, any point source of radiation could be used with this invention to provide an extended light source.

It should be noted that alternative embodiments of the present invention may include more than one light source for a single optical controller. In one such embodiment, the optical controller will have a circularly symmetric surface structure and a conical depression or similar elements corresponding to each light source, the light sources being arranged so that the exit surface of the optical controller provides an evenly spread extended light source.

Embodiments of the present invention have been described hereinabove by way of example only. It will be understood that modifications may be made to the specifically described examples without departing from the scope of the present invention.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. An apparatus for receiving light from one or more light sources, each comprising a substantially point-like light source, and emitting the light over an extended surface area, comprising:

a first surface of an optical controller arranged to refract light received from at least one light source;

a second surface of the optical controller arranged to reflect the light received from the first surface of the optical controller, said first surface and said second surface arranged with respect to each other to enable total internal reflection of the light received from said at least one light source; and a plurality of reflection elements distributed within the volume of the optical controller arranged to alter the path of the light traversing the optical controller so as to direct light out of the optical controller;

wherein said first surface further comprises a plurality of refraction elements arranged to refract light, received from the at least one light source, at an angle with respect to said second surface so as to enable total internal reflection;

wherein said plurality of refraction elements further comprises a plurality of first refraction elements arranged to receive light travelling normal to the first surface of the optical controller and refract the light as it passes into the optical controller, and a plurality of second refraction elements arranged to receive light that is not emitted in a direction normal to the first surface of the optical controller and refract the light as it passes into the optical controller;

wherein said second surface of the optical controller further comprises at least one conical depression feature arranged to reflect light refracted by the plurality of first refraction elements back into the optical controller.

2. The apparatus as claimed in claim 1 wherein the plurality of refraction elements are arranged in a circular symmetric pattern on said first surface.

3. The apparatus as claimed in claim 2 further comprising at least one light source arranged to emit light towards the optical controller.

4. The apparatus as claimed in claim 3, wherein said at least one light source is arranged so as to be substantially centrally aligned with respect to the circular symmetric pattern of the plurality of refraction elements.

5. The apparatus as claimed in claim 1 wherein the plurality of reflection elements are homogenously distributed throughout the optical controller.

6. The apparatus as claimed in claim 1 further comprising an outer casting on which the optical controller is mounted.

7. The apparatus as claimed in claim 6 further comprising at least one light source arranged to emit light towards the optical controller.

8. The apparatus as claimed in claim 7 wherein the at least one light source is secured to the outer casting in a position with respect to the optical controller.

9. The apparatus as claimed in claim 6 wherein the optical controller further comprises a plurality of tabs arranged so as to secure the optical controller with respect to the outer casting.

10. The apparatus as claimed in claim 9 further comprising at least one light source arranged to emit light towards the optical controller.

11. The apparatus as claimed in claim 10 wherein the at least one light source is secured to the outer casting in a position with respect to the optical controller.

12. The apparatus as claimed in claim 1 further comprising at least one light source arranged to emit light towards the optical controller.

13. The apparatus as claimed in claim 1, wherein the optical controller comprises a moulded transparent material.

14. A method for manufacturing an apparatus for receiving light from one or more light sources and emitting the light over a larger surface area, comprising the steps of:

providing an optical controller comprising:

a first surface of the optical controller arranged so as to refract light received from at least one light source;

a second surface of the optical controller arranged to reflect the light received from the first surface, said first surface and said second surface arranged with respect to each other to enable total internal reflection of the light received from said at least one light source; and a plurality of reflection elements distributed within the volume of the optical controller arranged to alter the path of the light traversing the optical controller so as to urge it to exit the optical controller;

providing at least one light source to emit light towards the optical controller; and providing an outer casting onto which the at least one light source and the optical controller are secured with respect to each other;

wherein providing said optical controller further comprises the step of providing a plurality of refraction elements on said first surface of the optical controller arranged to refract light, received from the at least one light source, at an angle with respect to said second surface so as to enable total internal reflection within said optical controller;

wherein providing said plurality of refraction elements further comprises the steps of providing a plurality of first refraction elements arranged to receive light travelling normal to the first surface of the optical controller and refract the light as it passes into the optical controller, and providing a plurality of second refraction elements arranged to receive light that is not emitted in a direction normal to the first surface of the optical controller and refract the light as it passes into the optical controller; and providing at least one conical depression feature on the second surface of the optical controller to reflect light refracted by the plurality of first refraction elements back into the optical controller.

15. The method as claimed in claim 14 further comprising the step of:

arranging said plurality of refraction elements in a circular symmetric pattern on said first surface.

16. The method as claimed in claim 15 further comprising the step of:

securing said at least one light source to said outer casting so that the at least one light source is arranged so as to be substantially centrally aligned with respect to the circular symmetric pattern of the plurality of refraction elements.

17. The method as claimed in claim 14 wherein the step of providing a plurality of reflection elements further comprises the step of:

homogenously distributing the plurality of reflection elements throughout the optical controller.

18. The method as claimed in claim 14 further comprising the step of providing the optical controller with at least one tab to secure the optical controller to the outer casting.

19. The method as claimed in claim 14 further comprising the step of:

moulding said optical controller out of a transparent material.

20. A method for receiving light from one or more light sources and emitting the light over a larger surface area, comprising:

receiving light from at least one light source at a first surface of an optical controller and refracting the light as it passes into the optical controller;

receiving the light at a second surface of the optical controller and reflecting the light received from the first surface of the optical controller, said first surface and said second surface arranged with respect to each other to enable total internal reflection of the light received from said at least one light source; and altering the path of the light traversing the optical controller so as to urge the light to exit the optical controller, said altering provided by a plurality of reflection elements located within the optical controller;

wherein receiving the light from said at least one light source at said first surface of said optical controller further comprises the step of receiving the light at a plurality of refraction elements on said first surface, and refracting the light, received from the at least one light source, at an angle with respect to said second surface so as to enable total internal reflection within said optical controller;

wherein receiving the light at a plurality of refraction elements further comprises the steps of receiving light travelling normal to the first surface at a plurality of first refraction elements, and refracting the light traveling normal to said first surface as it passes into said optical controller, and receiving light that is not emitted in a direction normal to said first surface at a plurality of second refraction elements, and refracting the light that is not emitted in a direction normal to said first surface as it passes into said optical controller; and reflecting, by at least one conical depression feature on said second surface, light refracted by said plurality of first refraction elements back into the optical controller.

* * * * *